United States Patent [19]

Volk

[11] Patent Number: 4,557,351

[45] Date of Patent: Dec. 10, 1985

[54] LUBRICATION SYSTEM FOR A WALKING BEAM COMPRESSOR

[75] Inventor: Russell D. Volk, Denver, Colo.

[73] Assignee: Denice C. Reich Inc., Denver, Colo.

[21] Appl. No.: 634,390

[22] Filed: Jul. 25, 1984

[51] Int. Cl.[4] ..... F01B 31/10

[52] U.S. Cl. ..... 184/18; 92/153; 92/160; 184/19

[58] Field of Search ..... 92/158, 159, 160, 153; 184/18, 19, 109

[56] References Cited

U.S. PATENT DOCUMENTS 2,827,860 3/1958 Roberts ..... 92/160 X
4,345,734 8/1982 Studinger ..... 248/669

FOREIGN PATENT DOCUMENTS 18166 of 1902 United Kingdom ..... 92/159

*Primary Examiner*—Leonard E. Smith
*Attorney, Agent, or Firm*—Edwin H. Crabtree

[57] ABSTRACT

An improved lubrication system for lubricating the moving parts of a walking beam compressor used in compressing low pressure natural gas. The compressor is mounted on a walking beam oil pump. The lubrication system introduces oil through the length of a piston shaft and through a plurality of oil cooling chambers in the interior of a piston. The oil is then forced out through piston outlet ports disposed between the piston's compression rings and wear rings for providing an improved lubricant seal and extending the life of rings.

6 Claims, 6 Drawing Figures

LUBRICATION SYSTEM FOR A WALKING BEAM COMPRESSOR

BACKGROUND OF THE INVENTION

This invention relates to a lubrication system for lubricating a piston and cylinder and more particularly but not by way of limitation to a walking beam compressor used in conjunction with a walking beam oil pump. The compressor used for compressing low pressure natural gas.

In a walking beam compressor, which is activated by the motion of a walking beam of a walking beam oil pump, the lubrication of the piston and inner cylinder wall of the compressor is extremely important. The natural gas which is compressed provides a foreign environment which dilutes and dissolves the oil lubricant. This causes a critical lubrication problem greatly reducing the wear life of the piston, the cylinder wall and the rings.

In the past, lubricant has been introduced by drip feed around the top of the piston shaft with the oil circulating downwardly along the length of piston shaft saturating a felt oil retaining wiper mounted on top of the piston. The wiper introduces oil along the sides of the cylinder wall as the piston is raised and lowered in the cylinder. While the wiper may provide adequate lubrication in the upper portion of the cylinder, little or no lubricant is received in the lower portion of the cylinder, particularly when the piston is double-acting and the low pressure natural gas is compressed in both the top and bottom portions of the cylinder.

In the following U.S. patents various types of compressor lubrication systems are described. They are U.S. Pat. No. 729,537 to Buffum, U.S. Pat. No. 754,121 to Brush, U.S. Pat. No. 832,956 to Castelnau, U.S. Pat. No. 2,166,857 to Bugatti, U.S. Pat. No. 2,317,004 to Wallgren et al, U.S. Pat. No. 2,665,901 to Patterson, U.S. Pat. No. 4,005,763 to Wallis. None of these prior art patents address the problem of natural gas walking beam compressor lubrication nor do they describe the unique features and advantages of the subject lubrication system for providing a complete and improved lubrication system for a walking beam compressor.

SUMMARY OF THE INVENTION

The subject walking beam lubrication system introduces oil into the interior of the piston and between the piston's compressions rings and wear rings for greatly increasing the life of the rings.

Oil is introduced into the interior of the piston for cooling the piston thereby reducing the operating temperature of the compressor.

The lubrication system solves the problem of inadequate lubrication of the piston and inner cylinder wall when the walking beam compressor is used as a double-acting compressor for compressing natural gas introduced both in the top and bottom portions of the compressor cylinder.

The system further includes improved lubrication of the piston shaft which is slidably received in a piston shaft bearing. The piston shaft bearing receives lubricant and introduces the lubricant around the sides of the shaft as it moves up and down. The lubricant is also introduced down the sides of the shaft for receipt in a felt oil retainer wiper attached to the top of the piston.

The improved lubrication system for lubricating and cooling a piston and cylinder wall of a walking beam compressor mounted on a walking beam pump includes a pressure oil lubricator connected to a first oil line. The line is connected to a shaft inlet oil port in the side of the piston shaft. The shaft inlet oil port in the side of the piston shaft communicates with an oil bore extending along the length of the shaft. The oil bore communicates with a shaft outlet oil port disposed adjacent the interior of the piston. A plurality of oil chambers are radially disposed through the interior of the piston and communicate with the shaft outlet oil port for receiving oil therefrom. A plurality of piston oil outlet ports are disposed in the sides of the piston for introducing oil between the piston rings and the inner cylinder wall. The oil lubricator is also connected to a second oil line which is connected to a piston shaft bearing housing for introducing lubricant around the piston shaft bearing.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
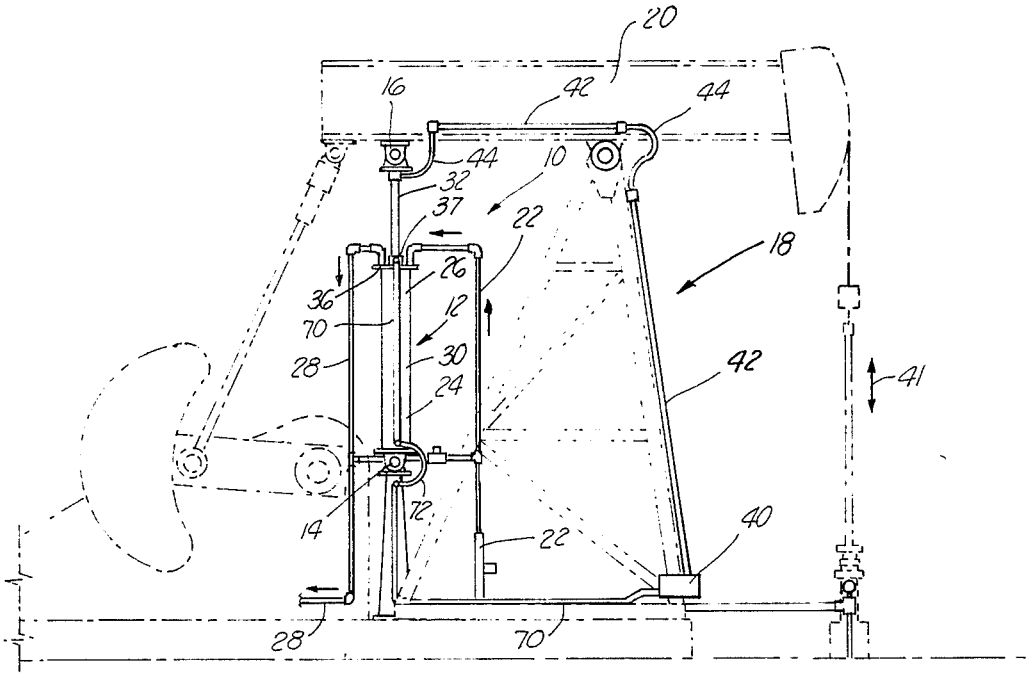
FIG. 1 is a view of the lubrication system attached to the compressor mounted on a walking beam oil pump shown in dotted lines.

In FIG. 1 the improved lubrication system for lubricating and cooling a piston and inner cylinder wall of a walking beam compressor is designated by general reference numeral 10. The system 10 is connected to a walking beam compressor 12 pivotally attached by a lower pivot bearing 14 and an upper pivot bearing 16 to a walking beam oil pump 18 having a walking beam 20. The walking beam compressor 12 is connected to a low pressure gas pipe 22 connected to a lower portion 24 and an upper portion 26 of the compressor 12. The compressor 12 acts as a double-acting compressor for compressing low pressure natural gas and discharging the compressed gas out a high pressure pipe 28.

Figure 2:
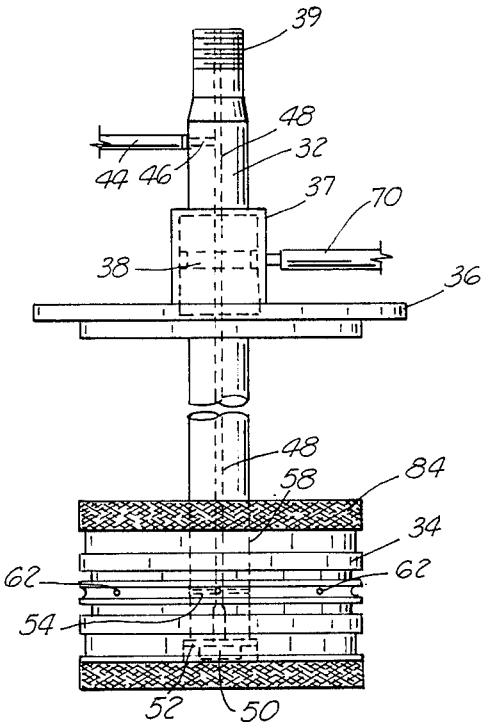
FIG. 2 is a side view of the piston and piston shaft.

The walking beam compressor 12 includes, in part, a cylinder 30, piston shaft 32, piston 34 shown in FIG. 2, upper cylinder plate 36, bearing housing 37 and bearing 38 disposed around the piston shaft 32. An upper threaded end portion 39 of the piston shaft 32 as shown in FIG. 2 is connected to the upper pivot bearing 16. When the walking beam oil pump 18 is in operation, the walking beam 20 is raised and lowered as shown by arrow 41 which in turn raises and lowers the piston shaft 32 with piston 34 connected thereto for compressing the low pressure natural gas received from the gas pipe 22.

The system 10 includes an oil lubricator 40 having a first oil line 42 with flex hoses 44. Oil received from the lubricator 40 through the oil line 42 and flex hoses 44 is introduced into the top of the piston shaft 32 through a shaft inlet port 46 which communicates with an oil bore 48 extending along the length of the shaft 32. The shaft inlet port 46 and oil bore 48 can be seen in FIG. 2. The oil bore 48 is formed in the shaft 32 through the use of a gun drilling operation or any similar machine tool operation. The ends of the shaft 32 are plugged with the piston 34 secured to the lower end of the shaft 32 through the use of a threaded bolt 50 and washer 52.

Referring now to FIG. 2, the piston 34 and piston shaft 32 are shown removed from the cylinder 30. When the oil is introduced through the oil bore 48, the oil travels along the length of the shaft 32 where it exits through a shaft outlet port 54 shown in dotted lines and disposed adjacent the interior of the piston 34. The oil is then received in an interior oil ring 56 inside a piston bore 58 which is used to receive the lower end of the piston shaft 32 therein. The ring 56 is shown in FIGS. 3 and 4.

Figure 3:
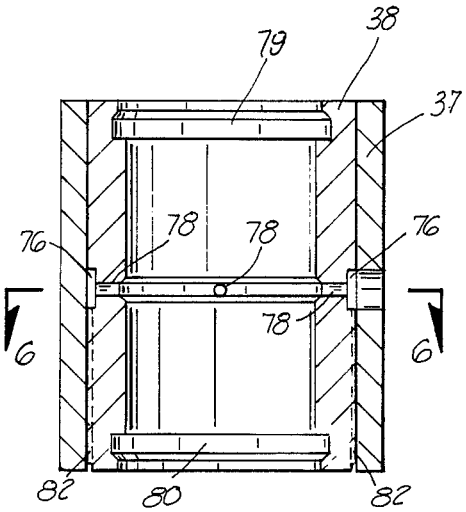
FIG. 3 is a side sectional view of the piston.
Figure 4:
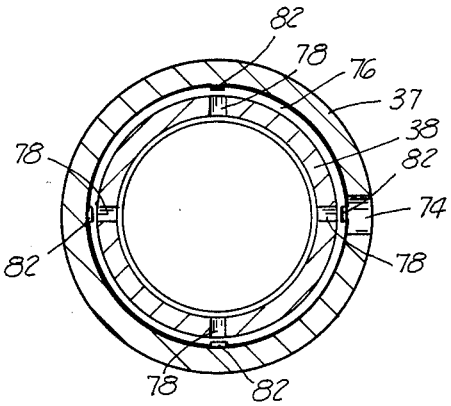
FIG. 4 is a sectional view taken along lines 4—4 shown in FIG. 3.

Referring now to FIGS. 3 and 4, the oil is then discharged outwardly from the ring 56 into radial oil cooling chambers 60. By introducing oil into the oil chambers 60, the operating temperature of the piston 34 is greatly reduced and in turn the overall operating temperature of the walking beam compressor 12 is reduced. Disposed around the outer periphery of the oil chambers 60 are piston outlet ports 62 which introduce oil between a pair of piston compression rings 64 and a pair of wear rings 66.

By introducing the oil from the oil chambers 60 through the piston outlet ports 62, the oil provides improved lubrication of the rings 64 and 66 along with providing an improved lubricant seal as the piston 34 compresses the natural gas in the upper and lower portion 24 and 26 of the compressor 12.

It should be pointed out that while, in the past, oil was introduced around the top of the piston shaft 32 in the cylinder 30, no provision was made to lubricate the lower portion 24 of the compressor 12 and therefore the lower compression ring 64 and wear ring 66 had accelerated wear due to the lack of sufficient lubrication thereby increasing the maintenance costs of the compressor 12.

To complement the lubrication of the piston 34 and inner cylinder wall of the cylinder 30, oil is also introduced through a second oil line 70 having flex hose 72 connected to the bearing housing 37. The bearing housing 37 surrounds a brass bearing 38 shown in cross-section in FIG. 5 and FIG. 6. The oil from the second oil line 70 is received through a bearing housing inlet port 74. The housing inlet port 74 communicates with a bearing oil ring 76 disposed around the outer circumference of the bearing 38. The ring 76 communicates with a plurality of bearing inlet ports 78 for introducing oil around the sides of the piston shaft 32 as it is raised and lowered inside the bearing 38. To insure there is no loss of pressure in the compression of the low pressure natural gas in the upper portion 26 of the cylinder 30 an upper wiper ring seal 79 and a lower wiper ring seal 80 are provided. The oil received around the sides of the piston shaft 32 not only acts to lubricate the shaft inside the bearing 38 but also provides a lubricant seal for the seals 78 and 80 and increases the wear life of the seal 78 and 80.

Figure 5:
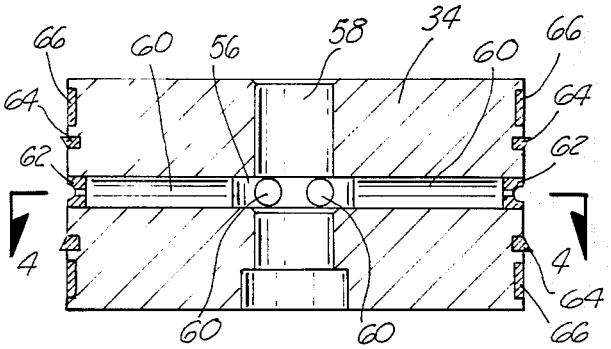
FIG. 5 is a side sectional view of the piston shaft bearing.
Figure 6:
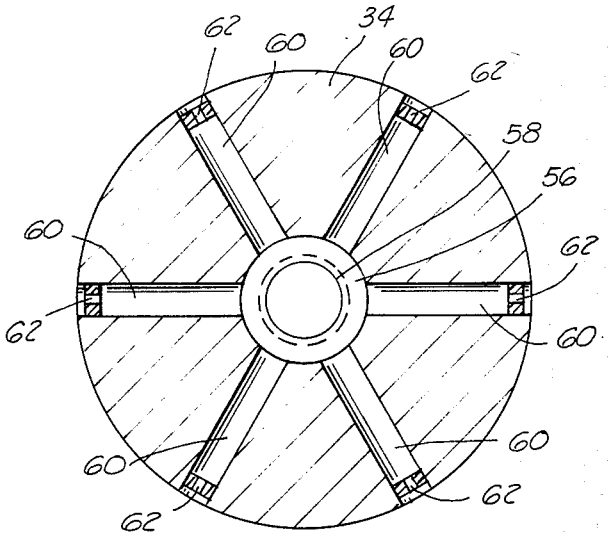
FIG. 6 is a sectional view taken along line 6—6 shown in FIG. 5.

Also communicating with the bearing oil ring 76 are oil grooves 82 shown in dotted lines in FIG. 5 and seen in FIG. 6. The grooves 82 also receive oil from the bearing housing inlet port 74 and feel the oil downwardly by gravity around the outer circumference of the piston shaft 32 inside the cylinder 30 and onto a felt oil retaining wiper pad 84. The pad 84 is shown in FIG. 2 attached to the top of the piston 34. The pad 84 receiving oil from the sides of the piston shaft 32 collects the oil and acts to lubricate the sides of the interior of the cylinder wall for increased lubrication of the piston 34 and cylinder 30.

From reviewing the above mentioned drawings, it can be seen, through the use of the improved lubrication system 10 for lubricating and cooling the piston 34 and the inner cylinder wall of the cylinder 30, the walking beam compressor 12 acting both as either a single acting or double acting compressor now is provided with sufficient lubrication for extended wear life when compressing low pressure natural gas. Further, the overall operation of a walking beam compressor is now improved for use in oil field applications when used in conjunction with a walking beam oil pump.

Changes may be made in the construction and arrangement of the parts or elements of the embodiments as described herein without departing from the spirit or scope of the invention defined in the following claims.

What is claimed is:

1. An improved lubrication system for lubricating and cooling a piston and inner cylinder wall of a walking beam compressor, the compressor mounted on a walking beam pump, the piston connected to a piston shaft which is raised and lowered by the movement of the walking beam of the walking beam pump, the shaft supported by a bearing housing having a bearing disposed around the piston shaft, the compressor used for compressing low pressure natural gas, the system comprising:

a pressure oil lubricator;

a first oil line connected to the lubricator;

a shaft inlet port in the side of the piston shaft, the inlet port connected to the first oil line;

an oil bore communicating with the shaft inlet port and extending along the length of the shaft;

a shaft outlet port disposed adjacent the interior of the piston;

a plurality of oil chambers radially disposed in the interior of the piston and communicating with the shaft outlet port;

a plurality of piston outlet ports in the sides of the piston and communicating with the oil chambers for introducing oil between the side of the piston and the cylinder wall;

a second oil line connected to the lubricator and to a bearing housing inlet port in the side of the bearing housing;

a bearing inlet port communicating with the bearing housing inlet port, the bearing inlet port receiving oil from the second oil line and introducing the oil around the piston shaft; and oil grooves along the side of the bearing and communicating with the bearing housing inlet port for introducing oil around the piston shaft inside the compressor.

2. An improved lubrication system for lubricating and cooling a piston and inner cylinder wall of a walking beam compressor, the compressor mounted on a walking beam pump, the piston connected to a piston shaft which is raised and lowered by the movement of the walking beam of the walking beam pump, the shaft supported by a bearing housing having a bearing disposed around the piston shaft, the compressor used for compressing low pressure natural gas, the system comprising:

a pressure oil lubricator;

a first oil line connected to the lubricator;

a shaft inlet port in the side of the piston shaft, the inlet port connected to the first oil line;

an oil bore communicating with the shaft inlet port and extending along the length of the shaft;

a shaft outlet port disposed adjacent the interior of the piston;

a plurality of oil chambers radially disposed through the interior of the piston and communicating with the shaft outlet port;

a plurality of piston outlet ports in the sides of the piston and communicating with the oil chambers for introducing oil between the side of the piston and the cylinder wall;

a second oil line connected to the lubricator and to a plurality of bearing inlet ports disposed in a spaced relationship radially around the bearing and communicating with a bearing oil ring disposed around the outer circumference of bearing, the bearing oil ring communicating with the bearing housing inlet ports, the bearing inlet ports introducing oil around the sides of the piston shaft; and oil grooves communicating with the bearing oil ring, the grooves receiving oil from the bearing housing inlet ports and feeding the oil downwardly by gravity around the outer circumference of the piston shaft inside the cylinder.

3. The system as described in claim 2 further including a felt oil retaining wiper pad, the pad attached to the top of the piston for receiving oil from the sides of the piston shaft for collecting and lubricating the sides of the interior of the cylinder wall for increased lubrication of the piston and cylinder.

4. The system as described in claim 3 further including a second felt oil retaining wiper pad attached to the bottom of the piston, the second pad collecting oil from the sides of the cylinder wall for lubricating the sides of the interior of the walls for increased lubrication of the piston and cylinder.

5. The system as described in claim 2 wherein the piston outlet port is disposed between a pair of compression rings mounted in the sides of the piston, the outlet port introducing oil for lubricating the compression rings and reducing the wear thereof.

6. The system as described in claim 2 further including a piston bore ring in the interior of the piston and communicating with the shaft outlet port and the plurality of oil chambers for receiving the oil from the shaft outlet port and introducing the oil into the oil chambers.

* * * * *